US005345051A

United States Patent [19]

Miike

[11] Patent Number: 5,345,051

[45] Date of Patent: Sep. 6, 1994

[54] PUSH-BUTTON SWITCH

[75] Inventor: Teruhisa Miike, Iwaki, Japan

[73] Assignee: Alps Electric Co., Ltd., Tokyo, Japan

[21] Appl. No.: 918,735

[22] Filed: Mar. 3, 1992

[30] Foreign Application Priority Data

Mar. 12, 1991 [JP] Japan ..... 3-021260[U]

[51] Int. Cl.[5] ..... H01H 13/70

[52] U.S. Cl. ..... 200/345; 200/510; 200/512; 200/520; 200/341

[58] Field of Search ..... 200/345, 510, 512, 520, 200/530, 534, 511, 239, 245, 247, 341, 513, 514, 515, 516, 517, 521, 523

[56] References Cited

U.S. PATENT DOCUMENTS

| | | | |
|---|---|---|---|
| 4,641,004 | 2/1987 | Keprda | 200/340 |
| 5,059,754 | 10/1991 | Kaichi et al. | 200/341 |
| 5,144,103 | 9/1992 | Suwa | 200/512 |
| 5,199,556 | 4/1993 | Lee | 200/520 |
| 5,199,557 | 4/1993 | Brandt et al. | 200/520 |

*Primary Examiner*—Henry J. Recla

*Assistant Examiner*—David J. Walczak

*Attorney, Agent, or Firm*—Guy W. Shoup; Patrick T. Bever

[57] ABSTRACT

A push-button switch which has a comparatively small overall thickness or height and rattling of a stem upon movement is eliminated or minimized. The push-button switch includes a stem having a flat plate and a plurality of legs each having a protruded portion at an end thereof. The flat plate of the stem is placed on a click rubber element accommodated in an insulating case while upper portions of the protruded portions of the stem are resiliently engaged with an open end of the insulating case to position the protruded portions within the insulating case. The insulating case has a plurality of relief grooves formed at a plurality of corner portions thereof, and when the stem is depressed, the protruded portions thereof are inserted into the relief grooves. Sliding surfaces for the protruded portions of the stem are formed at the corner portions of the insulating case between the open end of the insulating case and an inner bottom face of the relief grooves 25.

5 Claims, 3 Drawing Sheets

PUSH-BUTTON SWITCH

BACKGROUND OF THE INVENTION

1. Field of the Invention

This invention relates to a push-button switch of the automatic returning type which employs a click rubber element.

2. Description of the Related Art

Various push-button switches of the type mentioned are already known, and an exemplary one of such conventional push-button switches is shown in FIG. 6.

Referring to FIG. 6, the conventional push-button switch shown includes an insulating case 1 in the form of a box which is open at the top thereof. A recess 3 is formed on an inner bottom face 2 of the insulating case 1, and a pair of fixed contacts 4 are disposed in the recess 3. A click rubber element 5 is placed, at a base portion 5*a* extending outwardly downwards therefrom, on the inner bottom face 2 of the insulating case 1. The click rubber element 5 is held in the insulating case 1 with the base portion 5*a* thereof surrounded by a holding wall 6 of the insulating case 1. A stem 8 is placed on the top of the click rubber element 5 and has a flange 9 formed at the bottom thereof. The flange 9 of the stem 8 is fitted in an annular recess 10 formed at an upper portion of an inner face of the holding wall 6 of the insulating case 1. The stem 8 is normally urged upwardly by the click rubber element 5 to a normal position in which the flange 9 thereof is engaged with an upper end of the recess 10. When the stem 8 is depressed downwardly from the normal position, it moves downwardly while the flange 9 thereof slides on an annular bottom face of the recess 10, whereupon a lower face the stem 8 pushes the top of the click rubber element 5 downwardly to resiliently deform the click rubber element 5 until the movable contact 7 thereon are contacted with the fixed contacts 4 to short-circuit them to put the push-button switch into an on-state. Then, when the stem 8 is released, the resiliently deformed click rubber element 5 restores its original condition by its own resilient returning force, whereupon it pushes up the stem 8. Consequently, the movable contact 7 is spaced away from the fixed contacts 4 so that the push-button switch is returned into an original off-state.

However, according to the structure of the conventional push-up switch described above, since the flange 9 of the stem 8 slides on the bottom face of the annular recess 10 of the inner face of the holding wall of the insulating case 1, the stem 2 will not rattle during depression or returning upward movement of the stem 8. However, since the annular recess 10 which provides a sliding face for the flange 9 of the stem 8 is formed at the upper portion of the holding wall 6 for the click rubber element 5, the insulating case 1 has a great thickness or dimension in the vertical direction as much, and accordingly, there is a problem that the entire push-button switch has a corresponding great thickness in the vertical direction. Further, if the thickness of the insulating case 1 is reduced, then there may be another problem that it is difficult to assure a sufficient sliding face for the stem 8 and the stem 8 may rattle upon depression or returning thereof.

SUMMARY OF THE INVENTION

It is an object of the present invention to provide a push-button switch which has a comparatively small overall thickness or height and rattling of a stem upon movement is eliminated or minimized.

In order to attain the object, according an aspect of the present invention, there is provided a push-button switch which comprises an insulating case having a pair of fixed contacts provided on an inner bottom face thereof, a movable contact disposed in the insulating case for movement toward and away from the fixed contacts, and a stem disposed on the insulating case for operating the movable contact, the movable contact being resiliently operated, when the stem is depressed, by the stem into contact with the fixed contacts to put the push-button switch into an on-state, the stem having a flat plate and a plurality of legs each having a protruded portion at an end thereof, the flat plate of the stem being placed on the movable contact while upper portions of the protruded portions of the stem are resiliently engaged with the open end of the insulating case to position the protruded portions within the insulating case, the insulating case having formed at a plurality of corner portions thereof a plurality of guide holes in which the protruded portions of the stem are fitted such that the protruded portions slide on surfaces of the guide holes when they move in the guide holes upon depression or returning of the stem.

According to another aspect of the present invention, there is provided a push-button switch which comprises an insulating case having a pair of fixed contacts provided on an inner bottom face thereof, a click rubber element accommodated in the insulating case and placed on the inner bottom face of the insulating case, the click rubber element having a movable contact provided fixedly on an inner top face thereof, and a stem carried on the click rubber element for upward and downward movement in the insulating case, the click rubber element being operated, when the stem is depressed, by the stem into contact with the fixed contacts to put the push-button switch into an on-state, the stem having a flat plate and a plurality of legs each having a protruded portion at an end thereof, the flat plate of the stem being placed on the click rubber element while upper portions of the protruded portions of the stem are resiliently engaged with the open end of the insulating case to position the protruded portions within the insulating case, the insulating case having formed at a plurality of corner portions thereof a plurality of guide holes in which the protruded portions of the stem are fitted such that the protruded portions slide on surfaces of the guide holes when they move in the guide holes upon depression or returning of the stem.

With either of the push-button switches, the guide holes having the sliding contact surfaces for the protruded portions of the stem are formed to extend from the open end to the inner bottom face of the insulating case, and the thickness or dimension in the vertical direction of the insulating case is sufficient only if it has a dimension sufficient to provide the sliding contact surfaces, that is, the guide holes. Consequently, the push-button switch can be made with a reduced thickness or vertical dimension comparing with conventional push-button switches. Further, when the stem is operated, since the protruded portions thereof slidably move on the sliding contact surfaces at the corner portions of the insulating case, the stem will not rattle.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
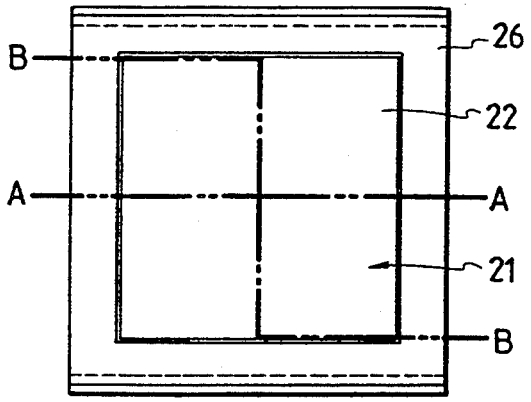
FIG. 1 is a top plan view of a push-button switch showing a preferred embodiment of the present invention.
Figure 2:
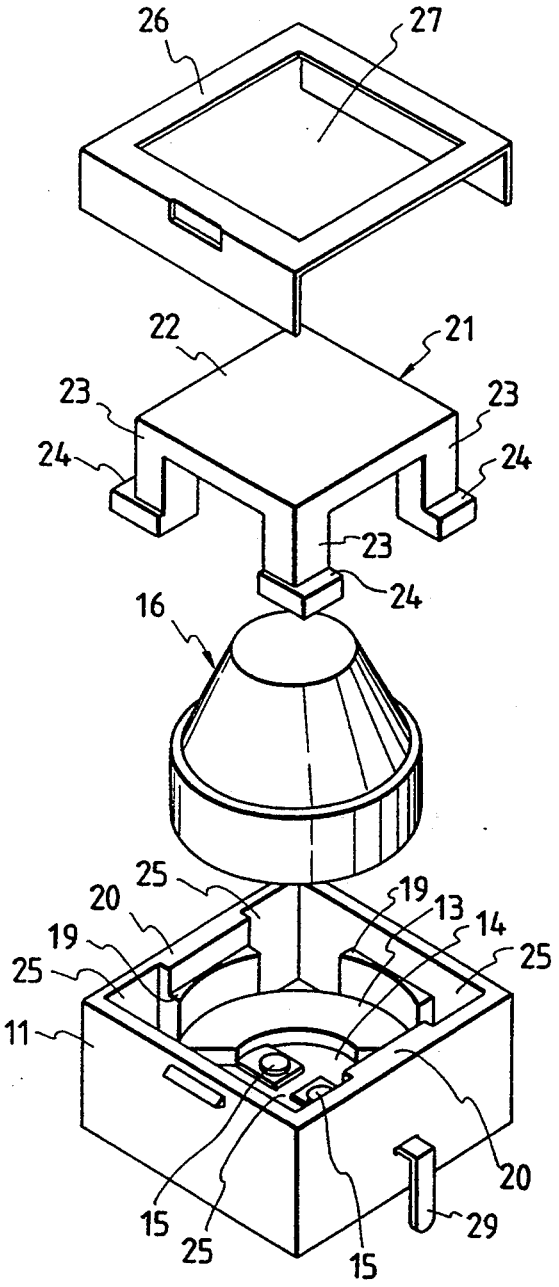
FIG. 2 is a fragmentary perspective view of the push-button switch.
Figure 3:
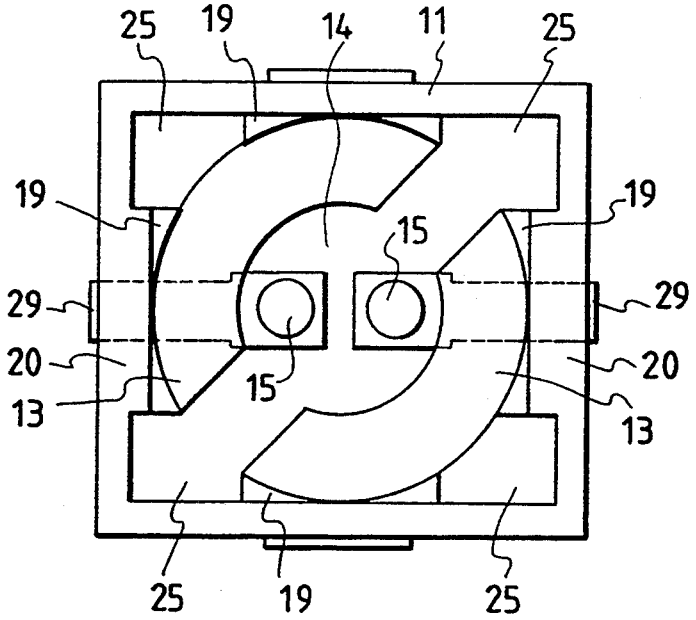
FIG. 3 is a plan view of an insulating case of the push-button switch.
Figure 4:
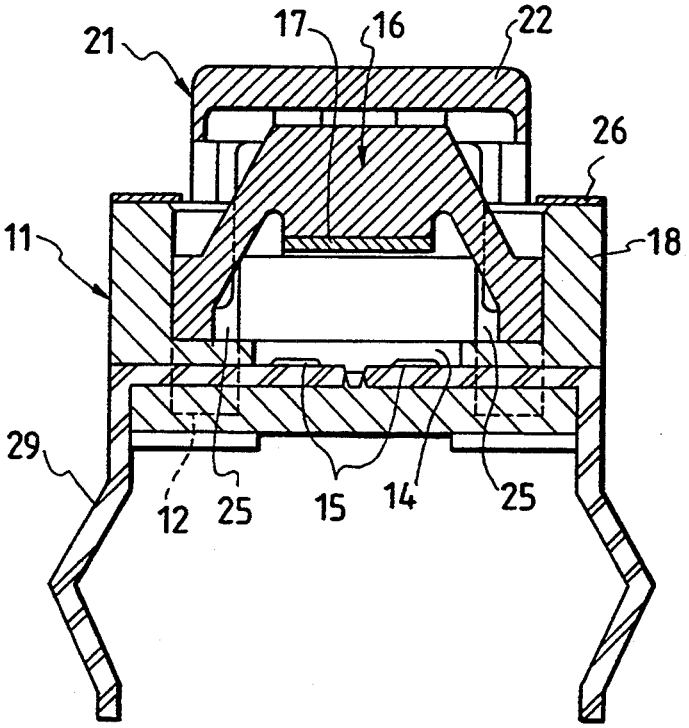
FIG. 4 is a sectional view taken along line A—A of FIG. 1.
Figure 5:
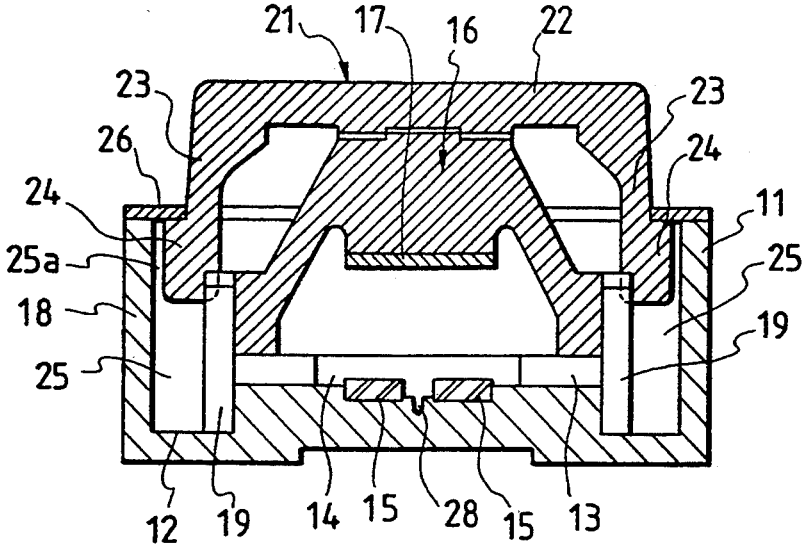
FIG. 5 is a sectional view taken along line B—B of FIG. 1.
Figure 6:
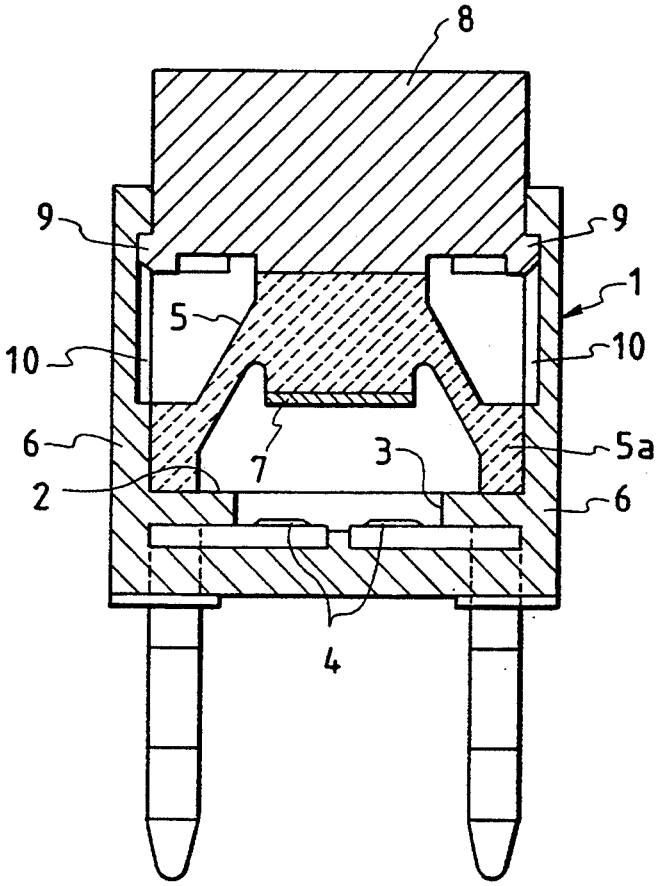
FIG. 6 PRIOR ART
FIG. 6 is a sectional view showing a conventional push-button switch.

Referring to FIGS. 1 to 5, there is shown a push-button switch to which the present invention is applied. The push-button switch shown includes an insulating case 11 made of an insulating material and having a substantially square horizontal section with the top end thereof opened. A pair of thicker portions 13 are provided on an inner bottom face 12 of the insulating case 11, and a pair of fixed contacts 15 are disposed in a recess 14 formed at a central location between the thicker portions 13. A click rubber element 16 is placed on the thicker portions 13 of the insulating case 11, and a movable contact 17 is securely mounted on an inner top face of the click rubber element 16. The click rubber element 16 is held by four click rubber element holders 19 provided uprightly on the thicker portions 13 on the inner sides of four side walls 18 of the insulating case 11. A pair of stem holders 20 are formed on inner faces of a pair of opposing ones of the side walls 18 of the insulating case 11 adjacent the click rubber element holders 19 and extend to an upper end of the insulating case 11. A stem 21 is placed on the top of the click rubber element 16. The stem 21 has a flat plate 22 and four legs 23 extending downwardly from four corners of the flat plate 22. The legs 23 of the stem 21 are tapered such that the thickness thereof decreases upwardly, and a protruded portion 24 is formed at an end portion of each of the legs 23. The flat plate 22 of the stem 21 is supported on the top of the click rubber element 16. The insulating case 11 has four guide holes **25*a* for the protruded portions 24 of the stem 21 formed at lower portions of the four inner corners thereof such that each of them is defined by a pair of adjacent perpendicular side walls 18 and a pair of adjacent click rubber element holders 19 and extends from an upper face of a thicker portion 13 to the inner bottom face 12. The insulating case 11 further has four relief grooves 25 formed contiguously to the guide holes 25*a*. A frame 26 is snap-fastened to a pair of opposing ones of the side walls 18 of the insulating plate 11 and covers the top ends of the side walls 13. The frame 26 has a rectangular hole 27 formed at the center thereof, and the click rubber element 16 extends upwardly through the rectangular hole 27. A groove 28 is formed on the inner bottom face 12 of the insulating case 11 between the fixed contacts 15 for accommodating dust or the like therein. A pair of terminals 29 extend downwardly from the fixed contacts 15 through the inner bottom face 12 of the insulating case 11** in order to allow external connection of the push-button switch.

The push-button switch described above is assembled in the following manner.

First, the click rubber element 16 is placed onto the thicker portions 13 of the insulating case 11, and the flat plate 22 of the stem 21 is placed onto the top of the click rubber element 16 while the legs 23 of the stem 21 are inserted into the four corner portions of the insulating case 11. Then, the frame 26 is fitted from above with the stem 21 such that the flat plate 22 of the stem 21 is projected upwardly through the rectangular hole 27 of the frame 26, and in this condition, the frame 26 is snap-fastened to the top end of the insulating case 11. Thus, the stem 21 is resiliently urged upwardly by the click rubber element 16 to its normal position at which upper portions of the protruded portions 24 of the stem 21 are resiliently contacted with the frame 26.

The push-button switch of the embodiment of the present invention has such a construction as described above. Thus, when the flat plate 22 of the stem 21 is depressed, the protruded portions 24 provided at the ends of the legs 23 of the stem 21 are moved down from the upper open end of the insulating case 11 along the guide holes **25*a* formed at the four corners of the insulating case 11 until they advance into the relief grooves 25. During such movement, the flat plate 22 of the stem 21 pushes the top of the click rubber element 16 downwardly to resiliently deform the click rubber element 16 until the movable contact 17 provided fixedly on the inner top face of the click rubber element 16 is contacted with the fixed contacts 15 on the inner bottom face 12 of the insulating case 11 to short-circuit the fixed contacts 15 to put the push-button switch into an on-stage. Then, if the stem 21 is released, then the click rubber element 16 which has been in a resiliently deformed condition till then pushes up the stem 21 by its own resilient returning force. Consequently, the movable contact 17 is spaced upwardly away from the fixed contacts 15** to return the push-button switch into an original off-state.

According to the push-button switch of the embodiment of the present invention, since the sliding contact faces for the protruded portions 24 of the stem 21 are provided by surfaces of the guide holes **25*a* and the relief grooves 25 formed at the corner portions of the insulating case 11 and extending to the inner bottom faces of the relief grooves 25 and the thickness or vertical dimension of the insulating case 11 must only be a dimension sufficient to allow such sliding contact faces to be provided, the push-button switch can be made with a reduced thickness or vertical dimension as compared with conventional push-button switches. Further, when the stem 21 is operated, the protruded portions 24 of the stem 21 are slidably contacted with the side walls 18 defining the corner portions of the insulating case 11, and consequently, the stem 21** will not rattle.

It is to be noted that, while the relief grooves 25 are provided contiguously to the guide holes **25*a* in the push-button switch of the embodiment described above, where a sufficient stroke of the stem 21 can be assured, the relief grooves 25 may not be provided while the inner bottom face of the insulating case 11 is formed as a substantially flat face. Further, the movable contact 17 need not be provided fixedly on the inner top face of the click rubber element 16, and alternatively, a movable contact in the form of a film may be disposed in an opposing relationship to the fixed contacts 15 such that the movable contact may be contacted with or spaced away from the fixed contacts by resilient deformation of the click rubber element 16 to effect switching of the push-button switch. Further, while the click rubber element 16** is employed as a contact member in the push-button switch of the embodiment described above, it is a mere example of contact member and a curved toggle leaf spring may be employed as such contact member.

Having now fully described the invention, it will be apparent to one of ordinary skill in the art that many changes and modifications can be made thereto without departing from the spirit and scope of the invention as set forth herein.

What is claimed is:

1. A push-button switch, comprising:

an insulating case having an inner bottom face and a plurality of walls extending from the inner bottom face, the plurality of walls defining an opening and a plurality of corner portions and a cover mounted over said opening, said cover having a peripheral flange defining an aperture;

a pair of fixed contacts provided on the inner bottom face;

a movable contact disposed in said insulating case for movement toward and away from said fixed contacts; and a stem disposed on said insulating case for operating said movable contact, said movable contact being resiliently biased away from said fixed contact such that, when said stem is depressed, said movable contact is pressed into contact with said fixed contacts to put said push-button switch into an on-state;

said stem having a flat plate extending through said aperture and a plurality of legs, each leg having a protruded portion at an end thereof which defines an abutment surface, said flat plate of said stem being placed on said movable contact while said abutment surfaces of said protruded portions of said stem are abuttingly engaged with the peripheral flange of said cover to position said protruded portions within said insulating case;

said insulating case having formed at each of said corner portions thereof a guide hole extending from the inner bottom face to the case opening in which one said protruded portions of said stem are slidably received such that said protruded portions slide within said guide holes between the inner bottom face and the open end upon depression or returning of the stem.

2. A push-button switch according to claim 1, wherein aid movable contact is constituted from a click rubber element.

3. A push-button switch, comprising:

an insulating case having an inner bottom face and a plurality of walls extending from the inner bottom face, the plurality of walls defining an opening and a plurality of corner portions and a cover mounted over said opening, said cover having a peripheral flange defining an aperture, said insulating case also having a raised holding portion located on the inner bottom face;

a pair of fixed contacts provided on the inner bottom face;

a click rubber element accommodated in said insulating case and placed on said raised holding portion of said insulating case, said click rubber element having a movable contact provided fixedly on an inner top face thereof; and a stem slidably mounted in said insulating case, said click rubber element being operated, when said stem is depressed, by said stem into contact with said fixed contacts to put said push-button switch into an on-state;

said stem having a flat plate extending through said aperture abutting said click rubber element and a plurality of legs each having a protruded portion at an end thereof which defines an abutment surface, said flat plate of said stem being placed on said click rubber element while said abutment surfaces of said protruded portions of said stem are abuttingly engaged with the peripheral flange of said cover to position said protruded portions within said insulating case;

said insulating case having formed at said plurality of corner portions thereof a plurality of guide holes composed of recesses extending from an upper end of said case to the inner bottom face in which said protruded portions of said stem slide within the guide holes between the inner bottom face and the open end upon depression and returning of the stem.

4. A push-button switch according to claim 3 wherein said stem is positioned in the insulation case with said protruded portions being resiliently engaged with said guide holes.

5. A push-button switch according to claim 1 wherein said stem is positioned in the insulation case with said protruded portions being resiliently engaged with said guide holes.

* * * * *